United States Patent [19]

Russell et al.

[11] Patent Number: 4,511,308

[45] Date of Patent: Apr. 16, 1985

[54] AXIAL AND MIXED FLOW FANS AND BLOWERS

[75] Inventors: Bruce A. Russell, Queenscliffe; Adnan M. Abdel-Fattah, Blacktown, both of Australia

[73] Assignee: James Howden Australia Pty. Limited, North Sydney, Australia

[21] Appl. No.: 403,493

[22] PCT Filed: Dec. 3, 1981

[86] PCT No.: PCT/AU81/00181

§ 371 Date: Jul. 14, 1982

§ 102(e) Date: Jul. 14, 1982

[87] PCT Pub. No.: WO82/01919

PCT Pub. Date: Jun. 10, 1982

[30] Foreign Application Priority Data

Dec. 3, 1980 [AU] Australia ..... 6741/80

[51] Int. Cl.[3] ..... F04D 29/52

[52] U.S. Cl. ..... 415/191; 415/207; 415/213 C

[58] Field of Search ..... 415/207, 208, 219 R, 415/191, 212 A, 213 C, 53 R, 119, 126–128; 416/189, 191, 179

[56] References Cited

U.S. PATENT DOCUMENTS

| | | | |
|---|---|---|---|
| 3,477,382 | 11/1969 | Watson | 415/207 |
| 3,535,540 | 10/1970 | Boulogne | 415/219 R X |
| 3,677,660 | 7/1972 | Taniguchi et al. | 415/207 UX |

FOREIGN PATENT DOCUMENTS

| | | | |
|---|---|---|---|
| 884850 | 6/1953 | Fed. Rep. of Germany | 415/207 |
| 1064191 | 8/1959 | Fed. Rep. of Germany | 415/208 |
| 289181 | 3/1965 | Netherlands | 415/208 |
| 2014240 | 8/1979 | United Kingdom . | |

*Primary Examiner*—Robert E. Garrett
*Assistant Examiner*—Joseph M. Pitko

[57] ABSTRACT

A stall-free axial flow fan (10) has an impeller (12) with a plurality of radially extending blades (14) enclosed in a tubular casing (11) divided into a inlet portion (15), an intermediate portion (16) of larger diameter than the minimum diameter of the inlet portion (15) and an outlet portion (17) of a diameter no larger than the minimum diameter of the inlet portion (15). Impeller (12) is positioned with the leading edge of each blade (14) protruding into the intermediate portion (16) and the trailing edge protruding into the outlet portion (17). Inlet portion (15) may contain a plurality of radially extending vanes (19) each rotatable about a spindle (20) and extending between the stator (18) and the inner wall of the inlet portion (15). Intermediate portion (16) may contain a plurality of fixed vanes (21) disposed radially of the stator (18) and axially of the casing (11).

9 Claims, 8 Drawing Figures

AXIAL AND MIXED FLOW FANS AND BLOWERS

TECHNICAL FIELD

The present invention relates to axial or mixed flow blowers or suction fans and more particularly to such blowers and fans which exhibit improved stability of operation.

BACKGROUND ART

It is known that conventional fans suffer from the problem of stalling when the gas flow past the fan blades breaks away from the surface of the blades and/or the housing surrounding the fan. The fans and blowers according to the present invention are designed to significantly reduce the liability of a stall condition occurring over a wide range of possible operating conditions.

DISCLOSURE OF THE INVENTION

The present invention consists in an axial or mixed flow blower or suction fan comprising an elongate tubular casing within which is disposed an impeller comprising a hub rotatable about the longitudinal axis of the casing and a plurality of blades extending radially therefrom, the casing comprising a tubular inlet portion which terminates in a tubular intermediate portion of larger cross sectional dimensions than the inlet portion which in turn terminates in a tubular outlet portion which is no larger in its cross sectional dimensions than the inlet portion, the impeller being so positioned that the leading edge of the tip of each blade is positioned within the intermediate portion while the trailing edge thereof is positioned within the outlet portion.

The casing of the blower or fan is preferably circular in cross sectional shape. The inlet portion is preferably frusto-conical or cylindrical while the intermediate and outlet portions are preferably cylindrical. The diameter of the outlet portion should not be greater than the minimum diameter of the inlet portion and is preferably slightly smaller than that minimum diameter. As is conventional in such fans the diameter of the outlet portion should be only slightly larger than the diameter of the circle swept by the rotating blades of the impeller.

The diameter of the intermediate portion is larger than the diameter, or minimum diameter, of the inlet and outlet portions. It is preferred that the diameter of the enlarged intermediate portion be from 1.1 to 1.5 times the diameter of the impeller and most preferably between 1.2 and 1.4 times that diameter.

There are preferably provided a plurality of fixed vanes within the intermediate portion which vanes are preferbly disposed radially of the hub and axially of the casing. It is particularly preferred that these vanes narrow in a downstream direction.

The commencement and termination of the intermediate portion are preferably both abrupt, with the intermediate portion being joined to the inlet or outlet portion by an annular wall portion which lies in a plane at right angles to the longitudinal axis of the fan or blower casing. While it is not essential that the intermediate portion terminates abruptly in a downstream direction, it is essential that this termination takes place, in an axial direction, between the leading and trailing edges of the impeller blades.

The arrangement according to this invention may be used with equal advantage in fixed or variable pitch fans and blowers.

In certain cases it is desirable to provide in the inlet portion a plurality of radially directed guide vanes which are each rotatable about its own longitudinal axis. These guide vanes preferably extend between the wall of the inlet portion and a cylindrical stator disposed coaxially with the casing. These guide vanes are preferably used in axial flow fans and blowers in which the blades of the impeller are not themselves rotatable about their own longitudinal axes. These variable pitch guide vanes may be positioned at angles relative to the longitudinal axis of the fan of from $+45°$ to $-90°$. The angle is considered to be positive if the vanes cause the incoming gas stream to be moved so as to increase the angle through which the direction of movement of the gas stream is changed by the impeller; it is considered negative when that angle is reduced. A similar convention is used when considering the fixed vanes in the intermediate portion. In fans and blowers where the impeller blades are of varible pitch such guide vanes are not generally required.

The minimum diameter of the inlet portion is preferably slightly larger than the impeller diameter. The most preferred minimum diameter of the inlet portion is from 1.01 to 1.1 times the impeller diameter. The stability of the fan for any given minimum diameter of the inlet portion increases as the axial distance between the leading edge of the impeller and the terminal edge of the inlet portions increases. This increased stability is however associated with a slight loss of efficiency.

BEST MODE OF CARRYING OUT THE INVENTION

Hereinafter given by way of example only are details of a variety of embodiments of the invention described with reference to the accompanying drawings in which.

In describing the various embodiments of this invention the same numeral will be used to describe the same integers in the different embodiments of the invention.

Figure 1:
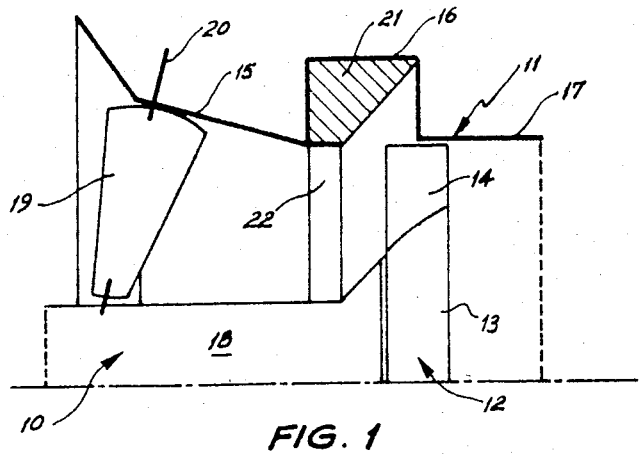
FIG. 1 is a diagrammatic longitudinal sectional view through one embodiment of a mixed flow fan according to this invention.

As is seen in FIGS. 1, 3, 5 and 6 the fan 10 comprises a casing 11 of circular cross sectional shape which surrounds and is coaxial with an impeller 12 which comprises a hub 13 and a plurality of radially directed blades 14. The cylindrical casing 11 is divided into three principal parts. A frusto-conical inlet part 15 terminates in a cylindrical imtermediate part 16 of enlarged diameter which in turn terminates in a cylindrical outlet part 17. The intermediate part 16 terminates and the outlet part commences intermediate the leading and trailing edge of the impeller blades 14.

Upstream of the impeller 12, and coaxial therewith is a stationary center tube or stator 18. A plurality of radially directed guide vanes 19, each mounted on a spindle 20, are positioned about the center tube 18. Each vane 19 extends radially outwardly to the inside surface of the inlet port 15 of the casing 11 and is rotatable about its spindle 20 such that the angle of the vane to the longitudinal axis of the fan may be varied.

Figure 3:
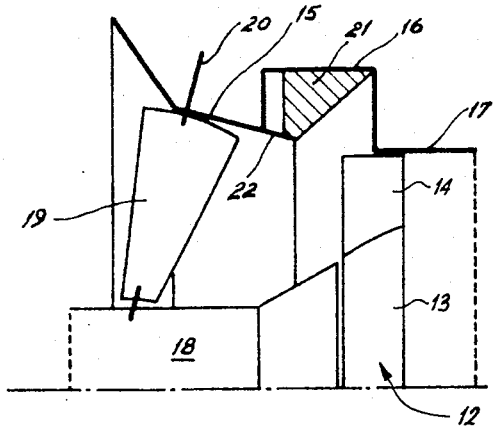
FIG. 3 is a diagrammatic longitudinal sectional view through another embodiment of a mixed flow fan according to this invention.
Figure 5:
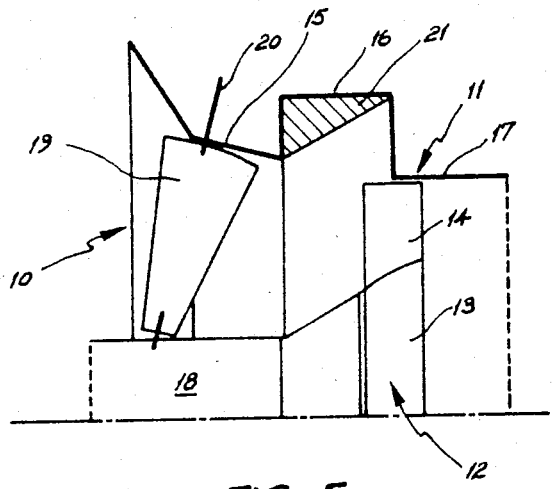
FIG. 5 is a diagrammatic longitudinal sectional view through a further embodiment of a mixed flow fan according to this invention.

The intermediate part 16 may include an array of fixed vanes 21 which may be axially of the fan as in FIGS. 3 and 5 or at an angle to that axis as in FIG. 1.

In the arrangement shown in FIG. 1 the minimum diameter of the inlet part 15 is equal to the diameter of the outlet part 17, i.e. approximately equal to the diameter of the impeller 12.

The intermediate portion includes a number of fixed vanes 21 each of which extends at 45° to the axis of the casing and is radially directed relative to the impeller.

The inlet portion 15 is extended rearwardly as cylindrical wall 22 which continues the minimum diameter of inlet portion 15 and is connected to the radially inner edges of the vanes 21.

Figure 2:
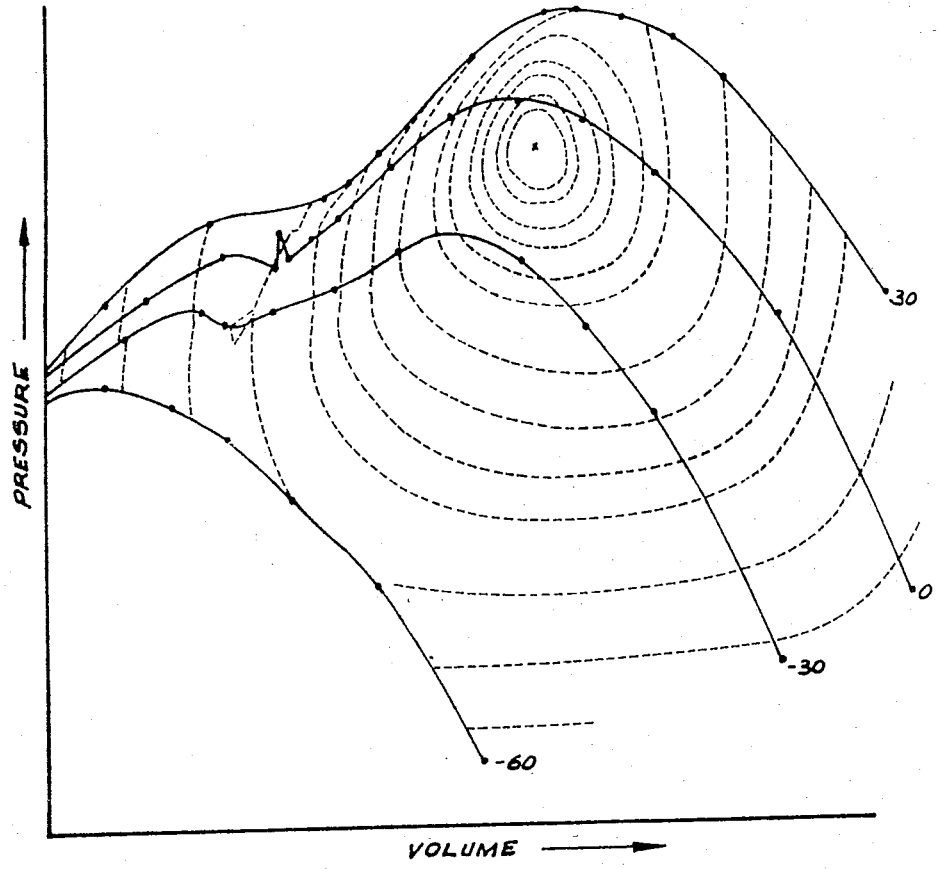
FIG. 2 is a pressure/volume diagram for the mixed flow fan of FIG. 1.

FIG. 2 is a pressure/volume diagram for the fan shown in FIG. 1. Each solid line represents the measured P/V relationship for the angular setting of moveable guide vanes indicated. The dotted lines represent contours of equal efficiency with the point of maximum efficiency marked with a cross. It can be seen from FIG. 2 that the fan of FIG. 1 showed a smooth P/V curve for all vane angles tested showing that the fan was not stalling at any point throughout its full operating ranges.

FIG. 3 shows another embodiment of the invention in which the intermediate portion includes a number of fixed vanes which extend axially of the casing and radially relative to the impeller. The inlet portion 15 is extended with the frusto conical wall 22 defining the minimum diameter of the inlet portion.

In this arrangement an aperture was left in the fixed vanes adjacent the leading edge of the intermediate portion to increase interaction of circulating flow between each pair of fixed stabilising vanes.

Figure 4:
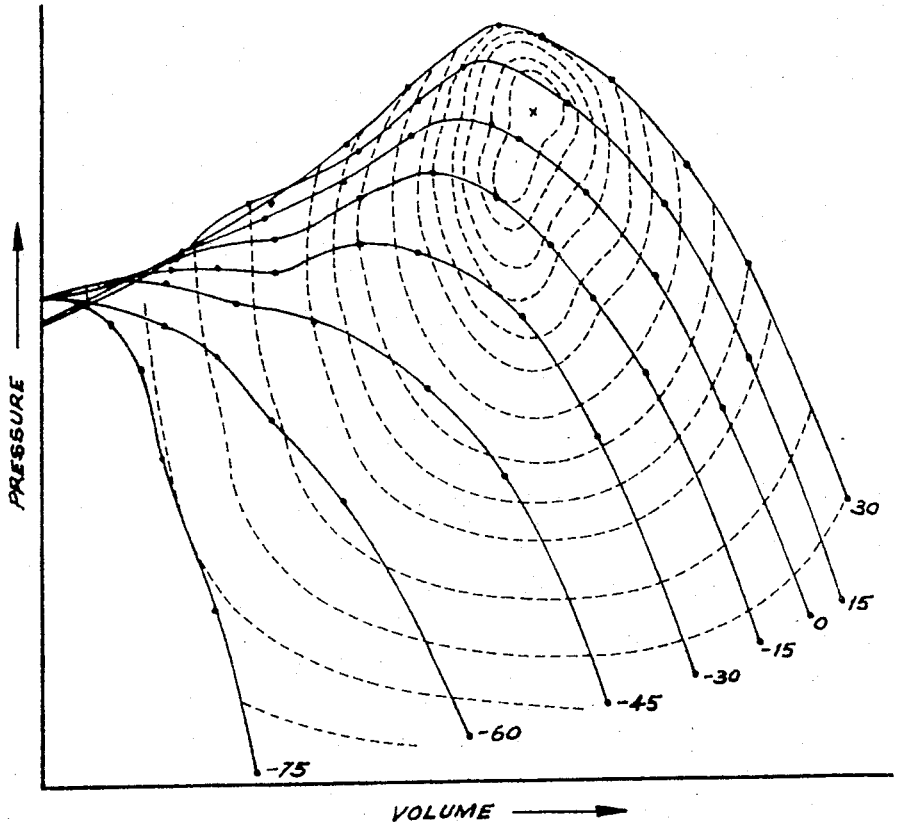
FIG. 4 is a pressure/volume diagram for the mixed flow fan of FIG. 3.

In can be seen from FIG. 4 that the above embodiment is free from stall characteristics.

Figure 6:
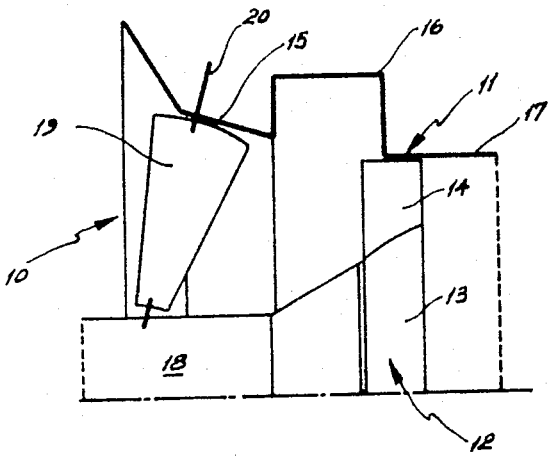
FIG. 6 is a diagrammatic longitudinal sectional view through a still further embodiment of a mixed flow fan according to this invention.

FIGS. 5 and 6 show further embodiments of the invention.

FIG. 5 shows an arrangement in which axially and radially disposed vanes 21 are provided in the intermediate portion. FIG. 6 shows a very similar arrangement but without the vanes. In each of these situations the inlet portion stops abruptly at the start of the intermediate portion.

Figure 7:
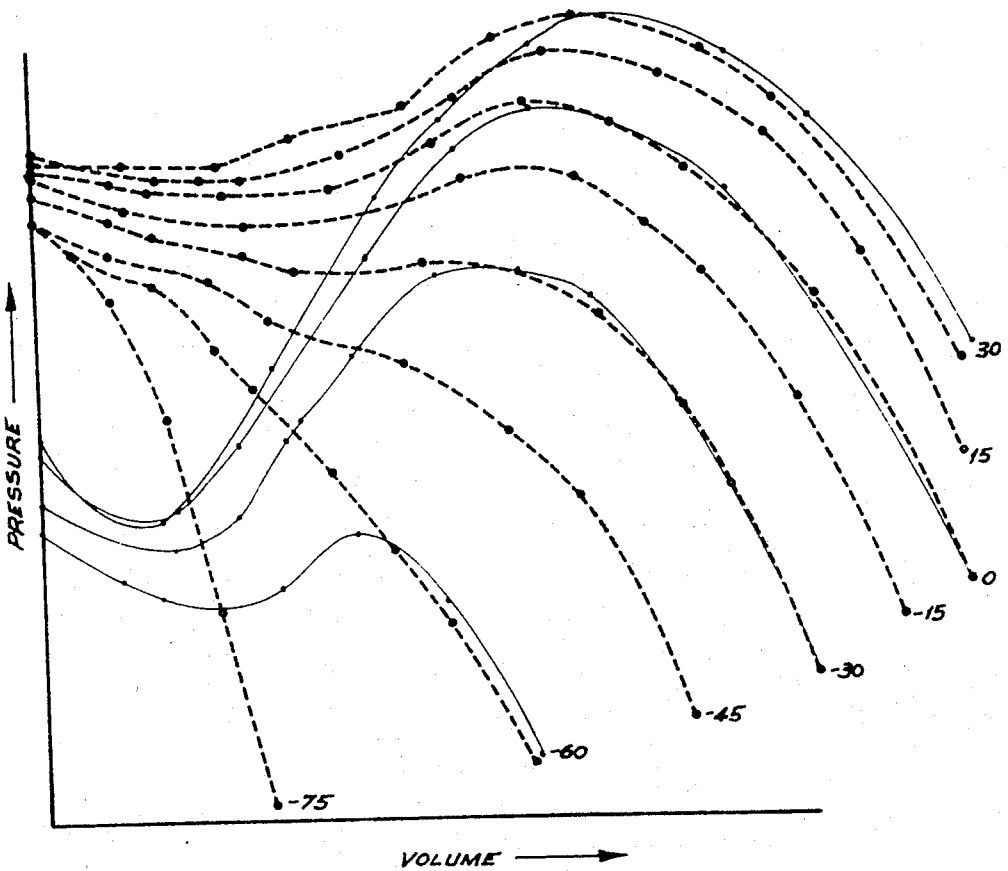
FIG. 7 is a pressure/volume diagram for the mixed flow fans of FIGS. 5 and 6.
Figure 8:
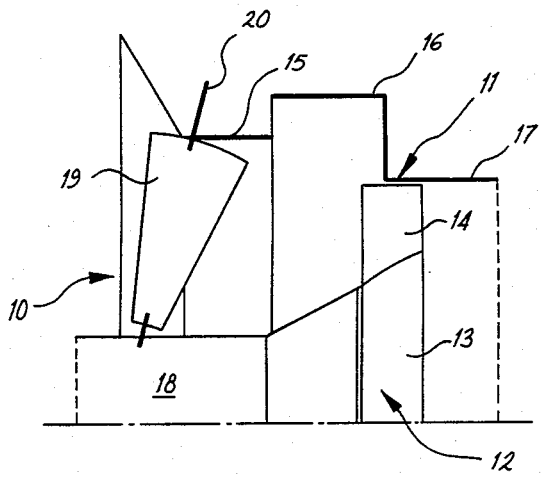
FIG. 8 is a diagrammatic longitudinal sectional view through still another embodiment of a mixed flow fan according to this invention.

FIG. 7 compares the P/V performance of the fans of FIGS. 5 and 6 with the FIG. 5 fan results shown in dashed lines and the FIG. 6 fan in solid lines. It can be seen that while the removal of the fixed guide vanes has not induced stalling in the fan, it has substantially reduced pressures at low volumes.

We claim:

1. A high pressure axial or mixed flow blower or suction fan, comprising: an elongate tubular casing, an impeller disposed within said casing and having a hub rotatable about a longitudinal axis of the casing, and also having a plurality of blades extending radially from said hub, each blade having a tip with a leading edge and a trailing edge, a stationary center tube positioned within said casing upstream of the hub and carrying a plurality of guide vanes extending radially therefrom, the casing comprising a tubular inlet portion the cross sectional area of which is constant or is reduced gradually along its length and which extends at least from the guide vanes in a downstream direction until it terminates in a tubular intermediate portion of larger cross sectional area than the inlet portion at its point of termination, the intermediate portion in turn terminating in a tubular outlet portion which is no larger in cross sectional area than the inlet portion at its point of termination, the inlet portion and the intermediate portion being connected by an imperforate and substantially annular first wall portion and the intermediate portion and the outlet portion being connected by an imperforate and substantially annular second wall portion, the impeller being so positioned that the leading edge of the tip of each blade is positioned within the intermediate portion while the trailing edge thereof is positioned within the outlet portion.

2. An axial or mixed flow blower or suction fan as claimed in claim 1, in which said casing is of circular cross section along its whole length.

3. An axial or mixed flow blower or suction fan as claimed in claim 2, in which the diameter of the intermediate portion is from 1.1 to 1.5 times the diameter of the impeller.

4. An axial or mixed flow blower or suction fan as claimed in any one of claims 1 to 3, in which a plurality of fixed vanes are provided in the intermediate portion of the casing, each vane extending axially of the casing and radially of the hub.

5. An axial or mixed flow blower or suction fan as claimed in claim 4, in which each vane decreases in depth in the direction of the outlet portion of the casing.

6. An axial or mixed flow blower or suction fan according to claim 1 in which the first annular wall portion lies in a plane at right angles to the longitudinal axis of the casing.

7. An axial or mixed flow blower or suction fan according to claim 1 in which the second annular wall portion lies in a plane at right angles to the longitudinal axis of the casing.

8. An axial or mixed flow blower or suction fan according to claim 1 in which the first and second annular wall portions lie in a plane at right angles to the longitudinal axis of the casing.

9. An axial or mixed flow blower or suction fan according to claim 1 in which said hub has a maximum diameter which is more than half the total diameter of the blades.

* * * * *